US005135579A

United States Patent [19]

Goettl

[11] Patent Number: 5,135,579

[45] Date of Patent: Aug. 4, 1992

[54] METHOD AND APPARATUS FOR REMOVING SEDIMENT FROM A POOL

[75] Inventor: John M. Goettl, Phoenix, Ariz.

[73] Assignee: Paramount Leisure Industries, Inc., Scottsdale, Ariz.

[21] Appl. No.: 428,862

[22] Filed: Oct. 30, 1989

[51] Int. Cl.[5] ..... B08B 3/02

[52] U.S. Cl. ..... 134/10; 134/24; 134/166 R; 134/169 R

[58] Field of Search ..... 134/166 R, 167 R, 169 R, 134/201, 22.18, 24

[56] References Cited

U.S. PATENT DOCUMENTS

| | | | |
|---|---|---|---|
| 3,045,829 | 7/1962 | Rule et al. . | |
| 3,245,420 | 4/1966 | Cherney | 134/167 R |
| 3,449,772 | 6/1969 | Werner | 134/167 R |
| 3,486,623 | 12/1969 | Bosico . | |
| 3,506,489 | 4/1970 | Baker . | |
| 3,521,304 | 7/1970 | Ghiz | 134/167 R |
| 3,615,013 | 10/1971 | Reece . | |
| 3,688,907 | 9/1972 | Oravec | 210/169 |
| 3,712,470 | 1/1973 | Gansloser | 210/169 X |
| 3,769,993 | 11/1973 | Schaeffer | 134/167 R |
| 4,114,206 | 9/1978 | Franc | 134/167 R |
| 4,193,870 | 3/1980 | Goodin . | |
| 4,282,893 | 8/1981 | Kane | 134/167 R |
| 4,330,412 | 5/1982 | Frederick . | |
| 4,419,233 | 12/1983 | Baker . | |
| 4,501,659 | 2/1985 | Henk . | |
| 4,520,514 | 6/1985 | Johnson | 134/167 R |
| 4,640,784 | 2/1987 | Cant | 210/169 X |
| 4,832,838 | 5/1989 | Stone . | |
| 4,904,379 | 2/1990 | Ward | 134/167 R |

*Primary Examiner*—Frankie L. Stinson
*Attorney, Agent, or Firm*—Joseph F. McLellan

[57] ABSTRACT

A method and apparatus for removing sediment such as leaves and debris from a pool by inducing turbulence in the pool water to stir up the sediment within local regions of the pool, and directing a steady jet of water from a stationary jet to provide a fixed direction gathering stream or pathway to capture and carry the sediment to the inlet of a leaf receiver which is fixed in position at the end of the pathway. Local area turbulence can be achieved in various ways, including the use of manual sweep brooms, water jet propelled devices carrying flexible sweep hoses, or an arrangement of rotary nozzles operative to sweep across and induce turbulence over camparatively large local regions of the pool. The leaf receiver in connected by a conduit to an externally located foraminous leaf collector mounted in a collector tank from which water is pumped, leaving the collected leaves in the leaf collector. An access cover in the pool deck can be opened to reach and withdraw the leaf collector for emptying. The leaf collector is on the inlet side of the pool pump, doubling as a pump leaf basket, and the usual pool filter is on the discharge side of the pump. The pump discharge is through a conduit having venturi orifices to draw water from the collector tank for discharge through a conduit emptying into the pool.

16 Claims, 3 Drawing Sheets

METHOD AND APPARATUS FOR REMOVING SEDIMENT FROM A POOL

BACKGROUND OF THE INVENTION

1. Field of the Invention

The present invention relates to a method and apparatus for automatically removing sediment from a pool by utilizing one or more stationary jets which establish fixed direction pathways terminating at the inlet of a leaf receiving means located in the pathway or pathways to receive leaves carried by the jets of water.

2. DESCRIPTION OF THE PRIOR ART

The material or sediment which accumulates in a swimming pool includes algae, decomposed vegetation, hair, dirt, grass, and heavier materials such as sand, seed pods and water soaked leaves.

Various systems have been used to place the lighter materials in suspension in the pool water so that they can be carried out of the pool drain and separated from the water by a filter. The lighter pool contaminants can be manually swept from the pool bottom and sides and placed in suspension by long handled brushes, or this can be done automatically by jet propelled pool cleaning devices which move across the water surface or over the surfaces of the pool. Such devices typically employ one or more flexible sweep hoses which move sinuously over the pool surfaces in reaction to water discharged from the ends of the hoses.

Another system for placing contaminants in suspension employs rotatable nozzles which are directed across different sectors of the pool by reason of actual rotation of the nozzle to different angular positions, or movement of an element internally of the nozzle which changes the direction of the jet Some such systems maintain the jet stream in each successive angular position for a period of time long enough that the momentum of the water extends the jet stream over a relatively large local area of the pool.

Yet another system utilizes fixed nozzles which are aimed to direct continuous streams of water over the pool surfaces to establish a circulatory flow pattern terminating near the pool drain.

The larger or heavier foreign materials, particularly leaves, are ineffectively removed by such systems. There are some pool cleaning devices which travel over the pool surfaces and carry a leaf bag into which are drawn any leaves encountered by the device. The other systems only tend to move the leaves about, depending upon random circulatory patterns of the water to bring the leaves close to the main pool drain. There the leaves can be caught in a leaf trap located over the main drain. Heavy accumulations of leaves are also commonly removed by a manually operated cleaner mounted to a long handle and manipulated over the pool surfaces. Leaves are drawn into a leaf bag on the device by means of a venturi suction action developed by directing water under pressure through the device Leaves are the typical but not the only heavier debris that must be removed from a pool. Accordingly, when the word "leaves" is used in the present specification and appended claims, it should be interpreted to include all debris of any significant weight that does not remain in suspension very long, i.e. sediment.

No satisfactory system exists for gathering heavier debris such as leaves from every part of the pool and carrying them to a leaf receiving means from which they can be conveniently removed. Leaf baskets located over pool main drains must be lifted out of the pool for emptying. Great care is required to keep the basket from tipping and emptying its contents into the pool. The same is true of traveling and manually operated leaf collectors since these also must be lifted out of the pool for emptying.

The known pool cleaning systems of the prior art are not effective to direct heavier debris such as leaves to any stationary collection device, instead randomly moving such debris throughout the pool and depending upon chance movement of the debris to place it in proximity with the pool drain. Movement of the leaves is random because it is affected by many factors, such as the shape of the pool. Eddies form that attract and entrap leaves in areas of lesser turbulence, such as adjacent the pool corners and steps Trapping also occurs in areas of convergence or overlap of jet streams from rotating nozzles. Although it is conceivable that a sufficient number of rotary jets or fixed jets could be provided to develop strong water flow patterns throughout the entire pool, such an arrangement is impractical. A much larger and more expensive pump system would be required than would be necessary for filtering lighter contaminants out of the pool water.

SUMMARY OF THE INVENTION

According to the present invention, a method and apparatus is provided for automatically removing sediment from a pool by utilizing a combination of local area turbulence inducing means, and a gathering pathway extending through the local regions The gathering pathway is a strong, relatively long length stream developed by a stationary jet. The stream developed by the jet is of sufficient duration and velocity that it extends over the length of most smaller pools, gathering leaves in its path and carrying them to the inlet of a leaf receiving means located in a fixed position at the bottom of the pool.

The turbulence for moving and temporarily suspending the leaves for random travel into or adjacent the higher velocity pathways can be provided by various means known in the art. As previously indicated, these include manual devices for sweeping the pool surfaces, but preferably the means are automatic devices such as those using flexible sweep hoses or rotary jets.

In one embodiment of the invention the stationary jet means comprises a first jet mounted on a side of the pool and oriented to direct water downwardly along the side of the pool and then along the pool bottom to the inlet of the leaf receiving means. A second jet located in the pool bottom in the pathway is oriented to develop a jet stream aligned with the pathway to augment the water velocity. In larger pools a plurality of such stationary jets can be located throughout the pool to establish fixed direction primary pathways and fixed direction secondary pathways intersecting the primary pathways. Leaves moving in the secondary pathways are passed to the primary pathways, and the primary pathways terminate at the inlet to a leaf receiving means.

The leaf receiving means comprises the inlet and a connecting conduit which carries the leaves to a leaf collecting means located externally of the pool. The leaf collecting means comprises a tank, a mount located in the tank, and a foraminous leaf collector carried by the mount and coupled to the connecting conduit for receiving the leaves. The pool pump draws water from the tank for circulation through the filtration system, and its discharge is back into the tank through a venturi jet which is directed into a discharge conduit emptying into the pool. This accelerates the discharge flow rate into the pool.

The mount incorporates a handle valve means enabling separation of the mount from the tank for removal of leaves from the leaf collector.

The present method and apparatus is operable with the conventional pump and filter system, but it is adapted also to operate in conjunction with sweep hose or rotary jet or other systems used for developing local area turbulence.

Other objects and features of the invention will become apparent from consideration of the following description taken in conjunction with the accompanying drawings.

DESCRIPTION OF THE PREFERRED EMBODIMENTS

Figure 1:
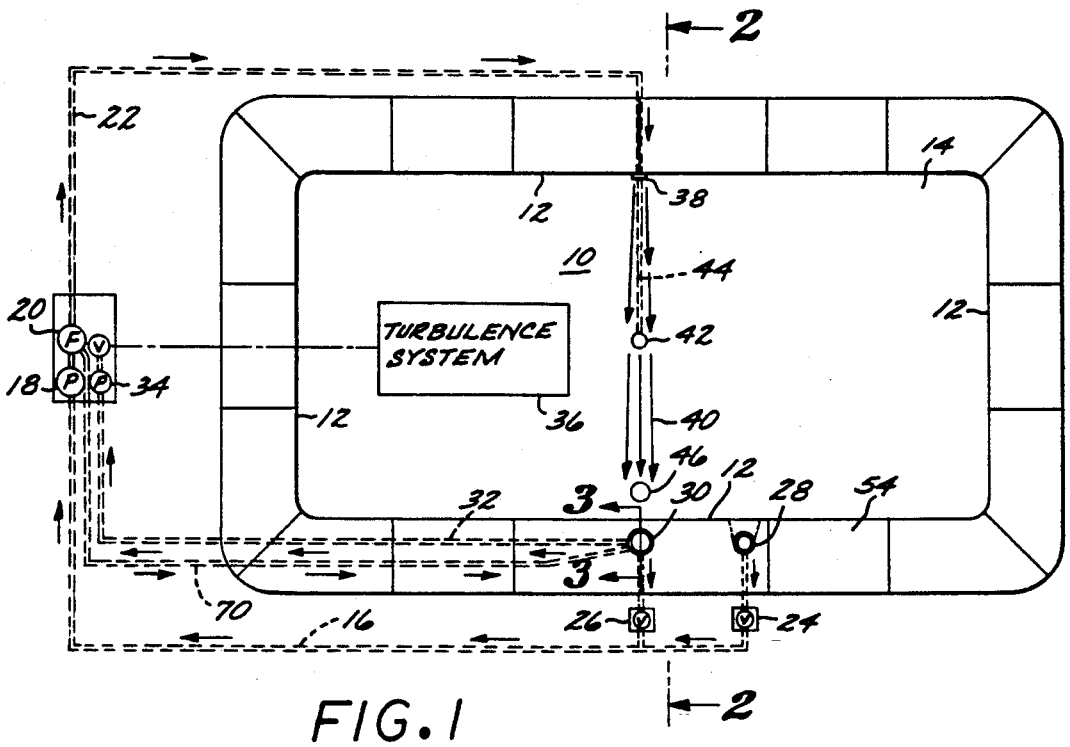
FIG. 1 is a schematic plan view of a swimming pool equipped with the apparatus of the invention for removing leaves from the pool.

Referring now to the drawings and particularly to FIGS. 1-6, the apparatus of the present invention is illustrated in association with a generally rectangular water filled swimming pool 10 having sides 12 and a bottom 14. Although any of a variety of plumbing systems can satisfactorily be employed with the apparatus of the invention, the system illustrated is typical, including an inlet conduit 16 which carries water to the inlet side of a pump 18 whose discharge is connected to the inlet side of a filter 20 for discharge through an outlet conduit 22.

The inlet conduit 16 is selectively coupled through valves 24 and 26, respectively, to a conventional pool skimmer 28 opening out of a side of the pool, and a leaf trap or receiving means 30. The leaf receiving means is also coupled by a conduit 32 to the inlet side of an auxiliary or booster pump 34 whose discharge operates a local area turbulence system generally designated by the numeral 36.

Although eddies or turbulence in localized regions of the pool can be achieved by manual means, such as by brushes mounted to long handles, an automatic turbulence system 36 is preferred because it operates continuously and contemporaneously with the stationary jets of the present apparatus, as will be seen, and tends to keep the leaves in motion in the localized region in which it is operating. The system 36 can be of that type which is movable through successive smaller or localized regions of the pool, employing flexible hoses from which streams or jets of water are discharged. The reaction from the jets moves the hoses in a sinuous fashion, directing the discharged water randomly over the adjacent pool surfaces and physically scrubbing the hoses against the pool surface. Rotary jets can also be used, as will be seen.

The turbulence system 36 is effective to place smaller contaminant particles in suspension for circulation to the filter, and suspend and move leaves a short distance within the localized region in which the system 36 is operating.

A stationary jet or fixed nozzle means or nozzle 38 is mounted to a side of the pool approximately midway between its opposite ends. It is coupled to the outlet conduit 22 and oriented to direct its steady stream or jet of water downwardly and along a predominantly unidirectional fixed direction pathway 40 extending down the side and across the bottom of the pool, as indicated by the arrows seen in FIG. 2.

A second stationary nozzle 42 is mounted to the bottom of the pool in the pathway 40 and oriented to direct its steady stream or jet of water across the bottom of the pool in a path coincident with the pathway 40 to augment and accelerate the flow of water in the pathway. Like the nozzle 38, the nozzle 42 is coupled to the pump outlet conduit 22, but by a branch conduit 44.

A pool drain or leaf collection inlet means 46 is preferably located in the pool bottom adjacent the side of the pool opposite the stationary jet 38. It is fixed in position in the pathway 40 to intercept and receive leaves carried by the stream of water which defines the pathway.

Figure 2:
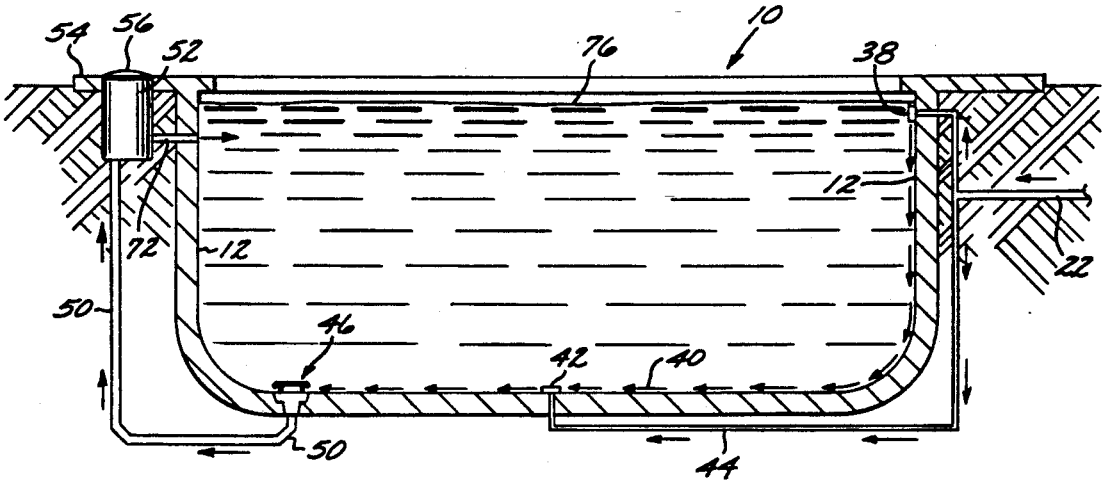
FIG. 2 is an enlarged view taken along the line 2-2 of FIG. 1.

The system of FIG. 2 is intended for use with a comparatively small pool, such as a 15 foot by 30 foot pool for example. The system of FIG. 7 is also designed for a smaller pool but it employs a particular local area turbulence system operative over larger local areas, as compared to a sweep hose system which must operate on successive smaller local areas.

Figure 7:
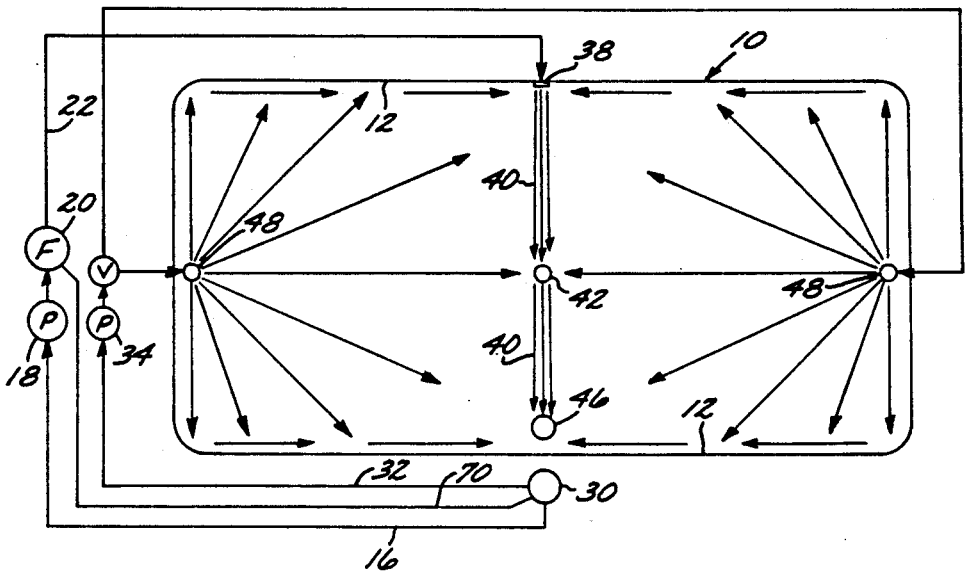
FIG. 7 is a schematic plan view of a swimming pool similar to that of FIG. 1, but employing rotary jets to induce turbulence in the local areas at opposite ends of the pool.

The system illustrated in FIG. 7 employs a pair of rotary nozzles 48 of any suitable type, such as the type disclosed in U.S. Pat. No. 3,506,489 (Baker) issued Apr. 14, 1970. The angular direction of the jet from each nozzle 48 is changed from one angular sector to another by a valve means which is associated with the nozzle and which is effective intermittently to shut off and turn on the flow of water to the nozzle and cause it to shift the jet stream position.

The Baker rotary nozzle is representative of rotary nozzles for radially directing a stream of water successively to successive sectors of the pool for relatively prolonged periods of time to extend the path of the discharged water, and thereby induce eddies or turbulence over a relatively widespread local region of the pool. Any of these nozzles can be used in the present apparatus.

In the example illustrated in FIG. 7, the pair of rotary nozzles 48 provides sufficient turbulence in the opposite halves of the pool to move leaves about in random fashion along the water flow paths indicated by the arrows. The leaves drifting into or encountering the more swiftly flowing unidirectional steady streams or pathways 40 provided by the stationary jets 38 and 42 will be carried along those pathways. In this respect the operation of the system of FIG. 7 is like that of FIG. 2.

Figure 8:
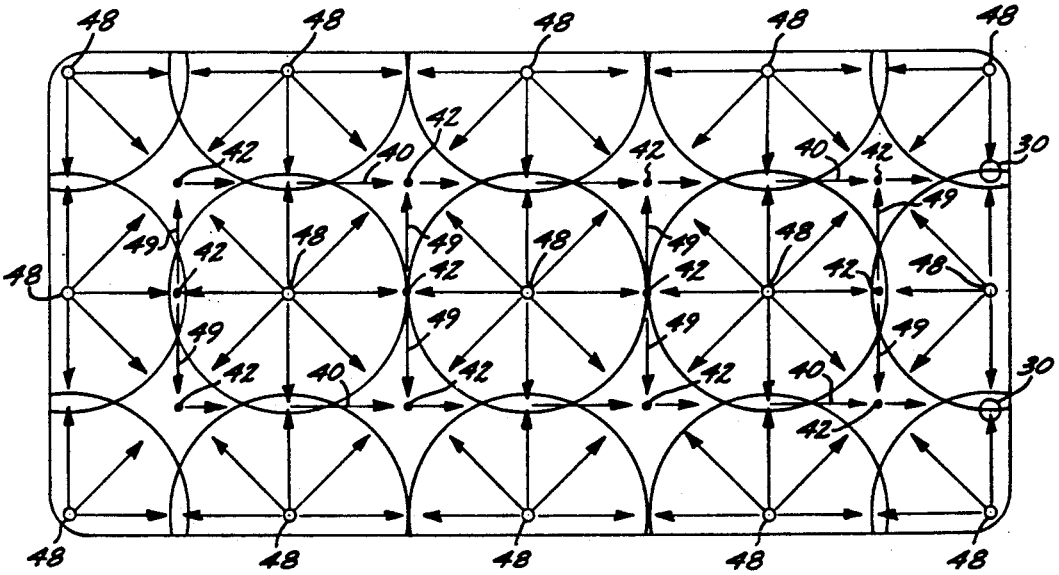
FIG. 8 is a schematic plan view of a larger pool employing a plurality of local area turbulence inducing means in combination with a plurality of stationary jets providing gathering streams or pathways extending through the local regions and terminating in a pair of leaf receiving means.

FIG. 8 illustrates a local area turbulence system better suited for relatively large pools in the order of 40 feet by 80 feet. A plurality of rotary nozzles 48 are employed at regular spaced intervals throughout the pool. The nozzles 48 are arranged in parallel longitudinal and transverse rows as illustrated. The local regions in which turbulence is induced by each of the nozzles 48 is schematically indicated by the partial or full circles adjacent to the nozzles.

The system of FIG. 8 also includes a plurality of stationary nozzles 42 arranged in parallel longitudinal and transverse rows. The longitudinal rows establish longitudinally directed primary leaf gathering streams or pathways 40, as indicated by the longitudinally directed arrows, while the nozzles 42 located between the longitudinal rows direct streams of water in opposite, lateral directions to establish secondary streams or pathways, as indicated by the arrows 49.

The action of the rotary nozzles 48 randomly outwardly moves leaves located in their local regions for interception by either the pathways 40 or 49. Leaves entrained in the secondary pathways 49 move to the pathways 40, and are carried along the pathways 40 to the collection inlet means 46 of a pair of leaf receiving means 30.

In both the embodiments of FIG. 2 and FIG. 8 the mixture of leaves and water passing into the leaf receiving means is carried by a connecting conduit 50 to the base of a cylindrical collector tank 52 which forms part of the externally located leaf collecting means of the receiving means 30. The tank is mounted within a suitable opening in the pool deck 54 and its open upper end is closed by a removable cover 56.

A mount 58 disposed within the tank 52 includes a downwardly oriented cylindrical flange 60 which slidably fits over the upper extremity of the cylindrical connecting conduit 50. The mount 58 further includes an arcuate seat or recess which receives a pivotable valve means or closure 62.

Figure 4:
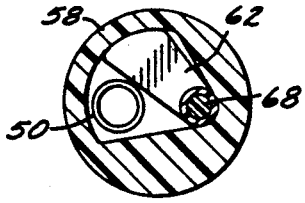
FIG. 4 is a view taken along the line 4-4 of FIG. 3, illustrating the handle valve means in an open position.
Figure 5:
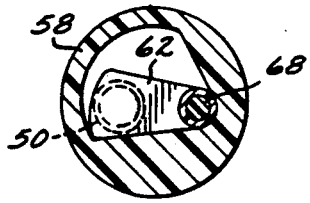
FIG. 5 is a view similar to FIG. 4, but illustrating the handle valve means in a closed position.
Figure 6:
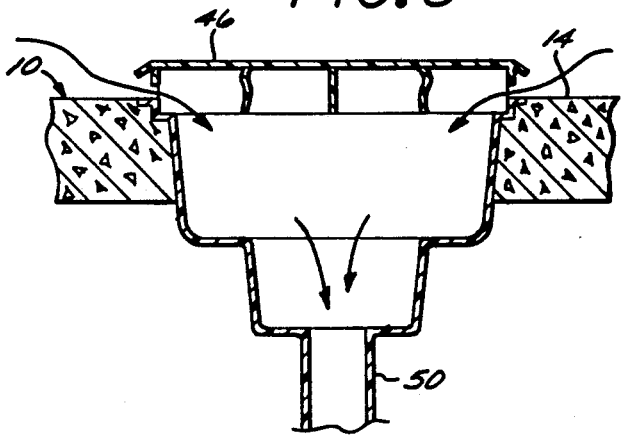
FIG. 6 is an enlarged view of the collection inlet of the leaf receiving means.

As best seen in FIGS. 4 and 5, the closure 62 can be pivoted from the open position illustrated in FIG. 4 to the closed position illustrated in FIG. 5. In the open position water and leaves are free to flow through the mount 58 into the interior of a foraminous leaf collector or bag 64. The lower end of the bag fits over a groove in the periphery of the mount 58 and is removably held in place by an elastic cord or ring 66.

Figure 3:
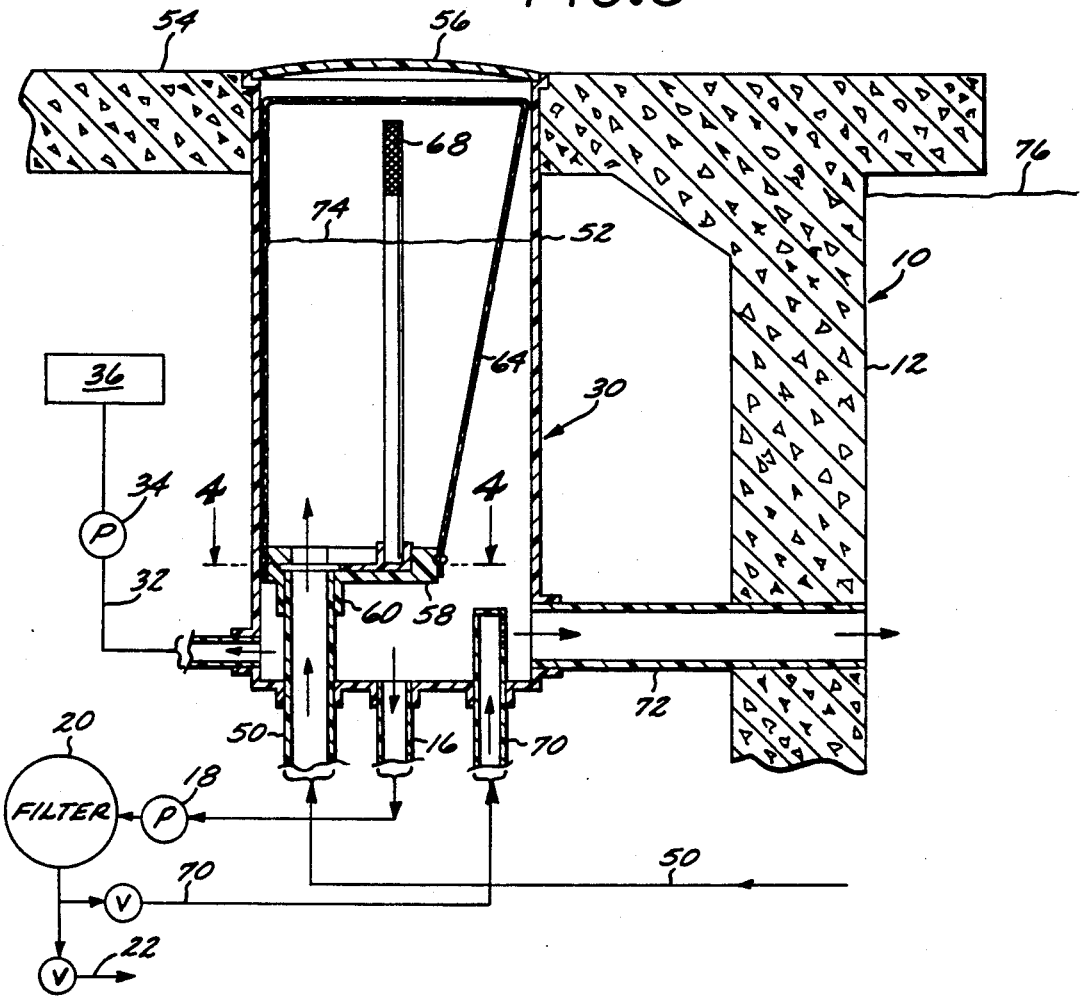
FIG. 3 is an enlarged view taken along the line 3-3 of FIG. 1.

The leaf bag 64 can be made of any suitable material, such as rigid screening or other apertured material, but the foraminous flexible bag 64 is preferred. It is illustrated in FIG. 3 in the shape it would assume with water passing into it from the conduit 50. This water passes through the bag and into the tank 52, and the remaining leaves collected in the bag 64 are easily removed by taking off the cover 56 and slidably separating the mount 58 from the conduit 50. This is done by pulling upwardly on an elongated, vertically oriented handle 68 which is also used for pivoting the closure 62.

The base of the tank also includes a flanged opening for coupling the tank 52 to the conduit 16 on the inlet side of the pump 18. The outlet side of the pump 18 is coupled to a tank inlet conduit 70 which discharges into the base of the tank 52.

The upper extremity of the conduit 70 includes one or more small apertures which serve as venturi nozzles to discharge water at increased velocity through the water in the base of the tank 52 and into a tank discharge conduit 72 which empties into the pool 10. The venturi effect enhances rapid flow of water from the tank 52 back into the pool.

It should be noted that the suction side of both the pump 18, and that of the booster pump 34 if one is used, are coupled to the tank 52 so that water passing to the pumps is already purged of leaves and other foreign matter. Consequently, the usual pump basket located at the inlet side of the pool and booster pumps can be eliminated.

Use of a booster pump 34 which is coupled to the tank 52 is helpful to further increase the rate of flow of leaves and water to the leaf bag 64 from the enlarged or oversize connecting conduit 50.

The height of the tank 52 is made such that the normal draw down or lowering of the operating level 74 of water in the tank places the level lower than the pool waterline 76, as seen in FIG. 3. This differential in water level improves discharge flow from the tank 52 through the tank discharge conduit 72. It also allows a back flow of water from the pool to the tank 52 to maintain pump suction should the connecting conduit 50 become blocked and fail to allow water to come into the tank from the collection inlet means 46.

In operation, and assuming that a booster pump 34 is utilized to operate a turbulence system 36 like that of FIG. 7, the rotary nozzles 48 will develop eddies or turbulence in a pair of relatively widespread local regions at opposite ends of the pool. Leaves and other foreign debris will be moved randomly toward the fixed direction, relatively swiftly flowing stream or pathway 40 developed by the stationary nozzles 38 and 42 which crosses the local turbulent regions. The leaves will be captured by the pathway 40 and discharged into the inlet means 46 of the leaf receiving means 30. From there they are carried by the connecting conduit 50 into the interior of the leaf collector bag 64.

The leaves are retained in the bag, and separated water passes into the tank 52 and then back to the pool through the tank discharge conduit 72. The venturi nozzles of the conduit 70 enhance the rate of this discharge. As previously indicated, the rate of discharge is further accelerated by connection of the booster pump inlet to the tank 52.

With the foregoing arrangement, the pathway 40 is always directionally oriented to terminate at the inlet to the leaf receiving means 30. Its continuous flow develops a momentum extending the pathway 40 the full length of the average size pool, and it is not appreciably diminished or deflected in direction by the local eddies developed by any turbulence system 36. Consequently, any leaves located in or adjacent the pathways are captured and carried to the inlet means 46. Streams of water which are random or which sweep through a pool sector are not relied upon for leaf removal, but serve only to develop local area turbulence to ready the leaves for capture by the steady state flow of the pathway 40 or pathways, as the case may be.

Various modifications and changes may be made with regard to the foregoing detailed description without departing from the spirit of the invention.

What is claimed is:

1. A method for removing sediment such as leaves and debris from a water filled pool comprising the steps of:

successively actuating a plurality of rotatable nozzle means mounted to structure of the pool to radially direct individual jets of water in successively different angular directions for developing turbulent eddies in separate local regions of the pool to stir up and place sediment in suspension in the turbulent eddies;

providing a fixed pool drain to accept waterborne sediment;

providing fixed nozzle means for developing a substantially unidirectional flow of the water in a substantially linear path directed to the positional location of the fixed pool drain; and intersecting the rotatable nozzle means developed turbulent eddies with the fixed nozzle means unidirectional flow of water in a path offset from the center of the rotatable nozzle means for capturing sediment in the eddies for transport to the pool drain in a substantially steady current.

2. A method according to claim 1 and including the steps of:

locating a leaf trap exteriorly of the pool, the leaf trap having an inlet dimensioned to allow leaves to flow into and be captured by the trap, and further having an apertured portion enabling water flow out of the trap for circulation into the pool; and coupling conduit means between the pool drain and the inlet of the leaf trap to carry waterborne leaves from the pool drain to the leaf trap.

3. A method according to claim 1 wherein the direction of the steady current is downwardly from a side of the pool and then across the bottom of the pool.

4. A method according to claim 1 wherein the utilizing step comprises utilizing the outputs of a plurality of fixed nozzle means to develop a plurality of separate primary steady currents, respectively, and a plurality of separate secondary steady currents intersecting the primary currents; and wherein a plurality of pool drains are located in fixed positions along the paths of the primary steady currents.

5. A method for removing sediment such as leaves and debris from a water filled pool comprising the steps of:

locating a pool drain in a fixed position within the pool;

continuously directing a jet of water from fixed nozzle means mounted to structure of the pool to develop a unidirectional steady current aimed at the pool drain to capture leaves in the steady current, the steady current being of a duration and velocity sufficient to carry leaves in the steady current to the pool drain;

successively actuating a plurality of omnidirectional nozzle means to radially direct jets of water for developing turbulent eddies in separate local regions of the pool to stir up and move sediment in the pool water for random travel toward the steady current; and, intersecting the turbulent eddies with the unidirectional steady current developed by the fixed nozzle means.

6. A method according to claim 5 and including the steps of:

locating a leaf trap exteriorly of the pool, the leaf trap having an inlet dimensioned to allow leaves to flow into and be captured by the trap, and further having an apertured portion enabling water flow out of the trap for circulation into the pool; and coupling conduit means between the pool drain and the inlet of the leaf trap to carry waterborne leaves from the pool drain to the leaf trap.

7. In combination with a water filled pool, apparatus for removing sediment such as leaves and debris from the pool comprising:

a pool drain located in fixed position within the pool for receiving waterborne sediment;

fixed nozzle means mounted to the pool for continuously directing a jet of water to develop a unidirectional steady current aimed at the pool drain to capture leaves, the steady current being of a duration and velocity sufficient to carry leaves moving into the steady current to the pool drain; and a plurality of omnidirectional nozzle means sequentially actuable to radially direct jets of water for developing turbulent eddies in separate local regions of the pool to stir up and move sediment in the pool water for random travel toward the steady current, the fixed nozzle means being positionally located for intersection of the turbulent eddies developed by the omnidirectional nozzle means by the unidirectional steady current.

8. The apparatus of claim 7 wherein the omnidirectional nozzle means comprises a plurality of movable nozzle means actuable for directing the jets of water into the pool for relatively prolonged periods of time and at different angular positions to develop eddies over a plurality of relatively widespread local regions of the pool.

9. The apparatus of claim 7 wherein the fixed nozzle means comprises a first nozzle means mounted to a side of the pool and oriented for directing a jet of water downwardly to develop the steady current in a path extending down the side of the pool and across the bottom of the pool to the pool drain.

10. The apparatus of claim 9 wherein the fixed nozzle means further comprises a second nozzle means mounted to the bottom of the pool in the path of the steady current and oriented for directing a jet of water across the bottom of the pool and aimed at the pool drain in a path coincident with the path of the steady current.

11. The apparatus of claim 10 wherein the fixed nozzle means comprises a plurality of first and second nozzle means mounted to the bottom of the pool and oriented for directing a plurality of jets of water, respectively, to develop separate, unidirectional primary steady currents, and separate, unidirectional secondary steady currents intersecting the primary steady currents; and including a plurality of separate pool drains located in the paths of the primary steady currents.

12. The apparatus of claim 7 and including leaf collecting means located externally of the pool, and conduit means coupling the pool drain and the leaf collecting means.

13. The apparatus of claim 12 wherein the leaf collecting means comprises a tank and a leaf trap located in the tank and coupled to the conduit means, the leaf trap having an apertured portion providing fluid communication with the tank.

14. The apparatus of claim 13 and including handle valve means movable between an open position providing communication between the leaf trap and the conduit means, and a closed position closing such communication, the leaf trap being separable from the tank for removal of leaves from the leaf trap.

15. The apparatus of claim 13 and including a pump means; a first tank discharge conduit coupling the tank to the inlet side of the pump means below the water level in the tank for pumping water out of the tank; a second tank discharge conduit coupling the tank to the pool; and a tank inlet conduit coupling the tank to the outlet side of the pump means, the tank inlet conduit including venturi means directed into the second tank discharge conduit to induce water flow from the tank into the second tank discharge conduit.

16. The apparatus of claim 7 and including a first pump means; a first tank discharge conduit coupling the tank to the inlet side of the pump means below the water level in the tank; a second tank discharge conduit coupling the tank to the pool; a second pump means; and a third tank discharge conduit coupling the second pump to the tank and to the omnidirectional nozzle means.

* * * * *